United States Patent [19]

Miura et al.

[11] 3,967,470

[45] July 6, 1976

[54] APPARATUS FOR NAPPING A CIRCULAR KNITTED FABRIC

[75] Inventors: Toshiaki Miura; Tatsuya Ugajin, both of Aichi; Masayoshi Inoue, Ichinomiya, all of Japan

[73] Assignee: Toray Textiles, Inc., Tokyo, Japan

[22] Filed: Jan. 31, 1975

[21] Appl. No.: 545,999

Related U.S. Application Data

[63] Continuation-in-part of Ser. No. 428,371, Dec. 26, 1973, abandoned.

[30] Foreign Application Priority Data

Dec. 29, 1972 Japan ..... 48-1124

[52] U.S. Cl. ..... 66/147; 26/31

[51] Int. Cl.[2] ..... D04B 35/00

[58] Field of Search ..... 66/147, 194; 26/28, 26/37, 31, 29 R

[56] References Cited

UNITED STATES PATENTS

| | | | |
|---|---|---|---|
| 544,682 | 8/1895 | McGenniss | 66/147 |
| 600,885 | 3/1898 | Musgrove | 66/147 |
| 1,018,562 | 2/1912 | Holmes | 26/28 |
| 1,961,939 | 6/1934 | Oakes | 66/147 |
| 2,053,778 | 9/1936 | Platt | 26/28 |

*Primary Examiner*—Mervin Stein
*Assistant Examiner*—Andrew M. Falik

[57] ABSTRACT

In apparatus for napping a circular knitted fabric between the knitting portion and the winding portion of a circular knitting machine, apparatus for napping the circular knitted fabric with emery in the form of a belt or the like. The invention includes a means for stretching the knitted fabric coursewise and an adjacent emery supporting base, an emery supporting frame structured to support said emery in the form of a belt or the like, and a driving portion provided to move said emery in a coursewise direction with respect to said circular knitted fabric while it is stretched coursewise.

8 Claims, 8 Drawing Figures

APPARATUS FOR NAPPING A CIRCULAR KNITTED FABRIC

RELATED APPLICATION

This is a continuation-in-part of our copending U.S. application Ser. No. 428,371, filed Dec. 26, 1973 now abandoned.

BACKGROUND OF THE INVENTION

The present invention relates to an apparatus for napping a circular knitted fabric on a circular knitting machine.

With respect to prior apparatus for napping a circular knitted fabric, it has heretofore been known that a card cloth or a card cloth roller may be used to raise the knitted fabric by touching the circular knitted fabric while it is proceeding in cylindrical form.

This process is superior to the process in which a knitted fabric is napped out of a circular knitting machine in the wale-wise direction. It shortens the whole process and lowers its cost.

However, in known napping process for circular knitting machines, it has been very difficult to adjust the contact pressure between the knitted fabric and the napping means, and this has caused considerable undesirable unevenness in the napping effect.

And further, because of the foregoing factors, the resulting napped circular knitted fabric tends to have reduced tenacity.

The present invention relates to an apparatus for napping a circular knitted fabric on a circular knitting machine, which overcomes the foregoing disadvantages and improves upon the prior knitted fabrics.

SUMMARY OF THE INVENTION

The present invention provides an apparatus for napping a circular knitted fabric having means for adjusting easily the contact pressure between the knitted fabric and the napping means, for making a uniformly napped circular knitted fabric, and for carrying out said napping process between the knitting portion and the winding portion of the circular knitting machine.

Another object of the present invention is to provide a uniform circular knitted fabric free of the defect of reduced tenacity.

These and other objects have been attained by the use of an apparatus for napping a circular knitted fabric having emery in the form of a belt for napping a circular knitted fabric, an emery supporting base for contacting said emery with said circular knitted fabric, an emery supporting frame for supporting said supporting base, and driving means arranged to move said emery in a coursewise direction in relation to said circular knitted fabric.

DETAILED DESCRIPTION OF PREFERRED EMBODIMENTS

Hereinbelow, the embodiments of the present invention will be explained by reference to the drawings. Explanations will be made mainly with reference to the case in which a circular knitted fabric is revolving while it moves forwardly (walewise) on an ordinary circular knitting machine. However, the present invention is also applicable when the circular knitted fabric proceeds forwardly without revolving.

Figure 1:
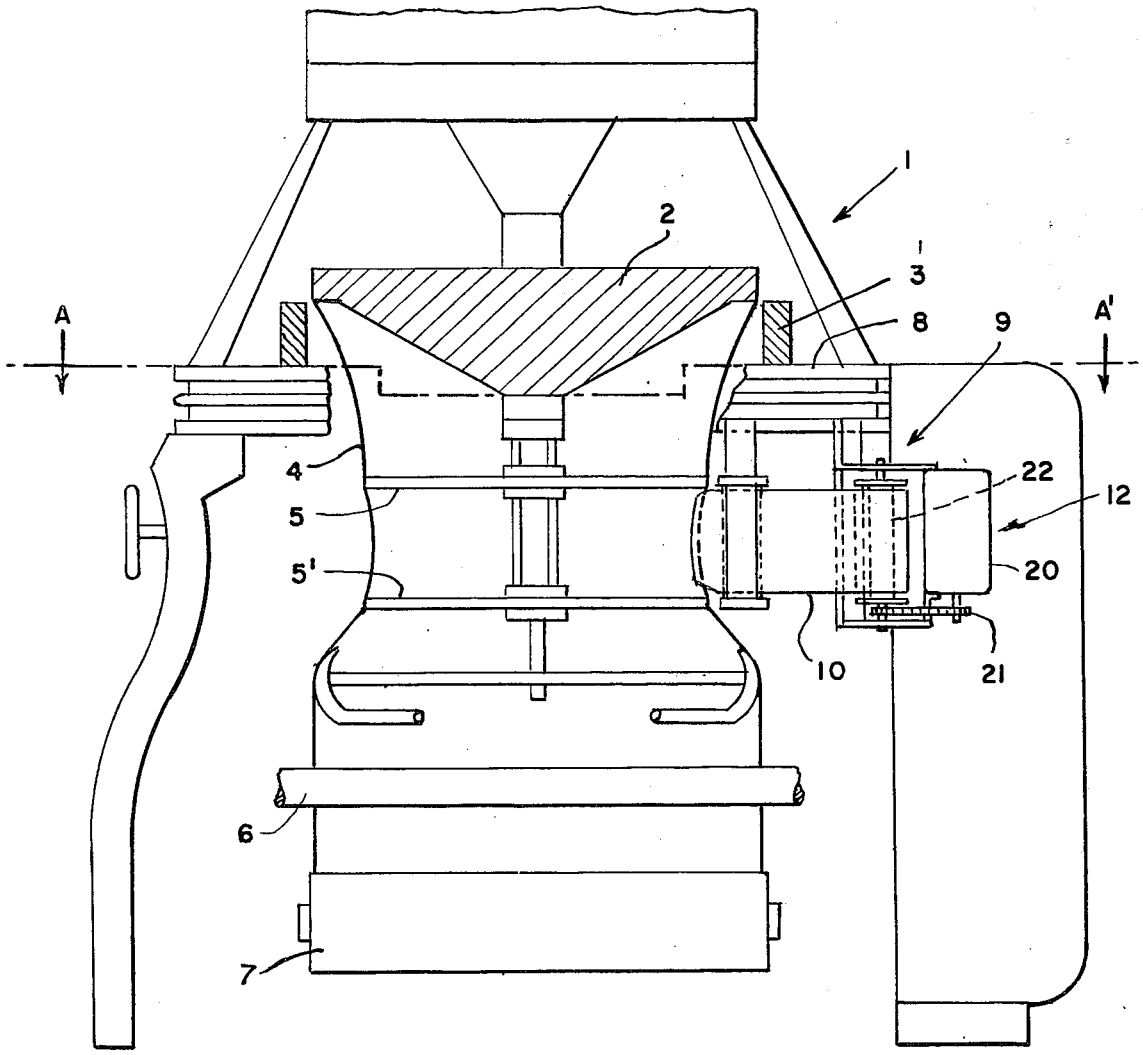
FIG. 1 is an elevational view of a circular knitting machine in combination with an apparatus which embodies features of the present invention.

Referring to FIG. 1, a circular knitted fabric 4 knitted between a dial 2 and a cylinder 3 of a circular knitting machine 1 proceeds while revolving, and the circular knitted fabric 4 is formed into cylindrical shape and stretched coursewise between spreaders 5 and 5′. This fabric 4 is wound on a winder 7 passing through a take-up roller 6.

A form of napping apparatus 9 of the present invention is shown in FIG. 1, it is provided on the frame 8 of the circular knitting machine 1, and naps the circular knitted fabric while the fabric is cylindrically shaped and maintained in a coursewise stretched condition at a location between spreaders 5, 5′.

Figure 2:
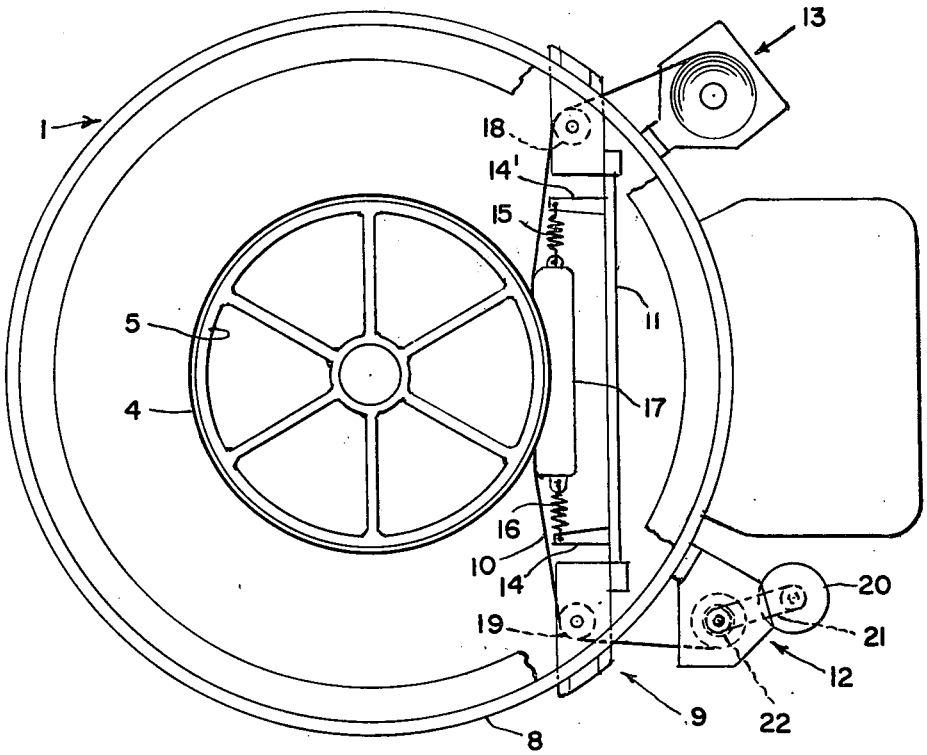
FIG. 2 is a plan view taken on line A–A′ in FIG. 1.

FIG. 2 is a plan view taken on line A–A′ in FIG. 1, which indicates that the napping apparatus 9 of the present invention is attached to the frame 8 of said circular knitting machine 1, and naps the circular knitted fabric 4.

A support frame 11 is provided for supporting an emery belt 10, a winding device 12 having the function of driving said emery belt 10, and a supply roll 13 is provided for supplying the emery belt.

In FIG. 2, a support base 17 is provided as a back-up for said emery belt 10. The support 17, which has a belt like shape, is suspended between branch arms 14, 14′ of said support frame 11 by means of springs 15, 16.

Emery belt 10 is used for napping the circular knitted fabric. It is supplied from a supply station 13 shown in the form of a package, and extends from supply portion 13 to winding portion 12 through slip roller 18, support 17 and slip roller 19 on the support frame 11, and is wound up gradually by the winding device 12.

The emery belt 10 naps the circular knitted fabric 4 with suitable contact pressure, backed up by the support base 17.

Either emery paper or emery cloth may be used as emery belt 10.

The desired roughness of the emery for use in accordance with this invention can be selected in accordance with the desired degree of napping, and it is easy to change the type and particle size of the emery.

After the emery on the belt has been used for a long time, it tends to become blocked or consumed. Therefore, it is preferably capable of being transferred so that the emery, after being used for a predetermined time, may be replaced automatically by a fresh emery surface.

The travel of emery in the form of a belt is attained by winding said belt 10 on a winding tube 22. The winding tube 22 is caused to rotate by a chain 21 driven by a motor 20 (See FIGS. 1, 2).

One of the important characteristics of the present invention is the attachment of the support base 17 of the napping attachment (namely the portion adapted to nap the circular knitted fabric) to a fixed support frame with springs, as indicated in FIG. 2.

The emery napping element of the present invention may be held always under uniform contact pressure against the circular knitted fabric 4; therefore the circular knitted fabric is uniformly napped in accordance with this invention.

Although FIG. 2 mainly illustrates one form of the invention, adapted to wind up the emery in the form of a belt, other forms may be used, including a form in which said emery is used in endless form, by slight modification. Emery in the form of an endless belt is illustrated in FIG. 2*a*.

Figure 2A:
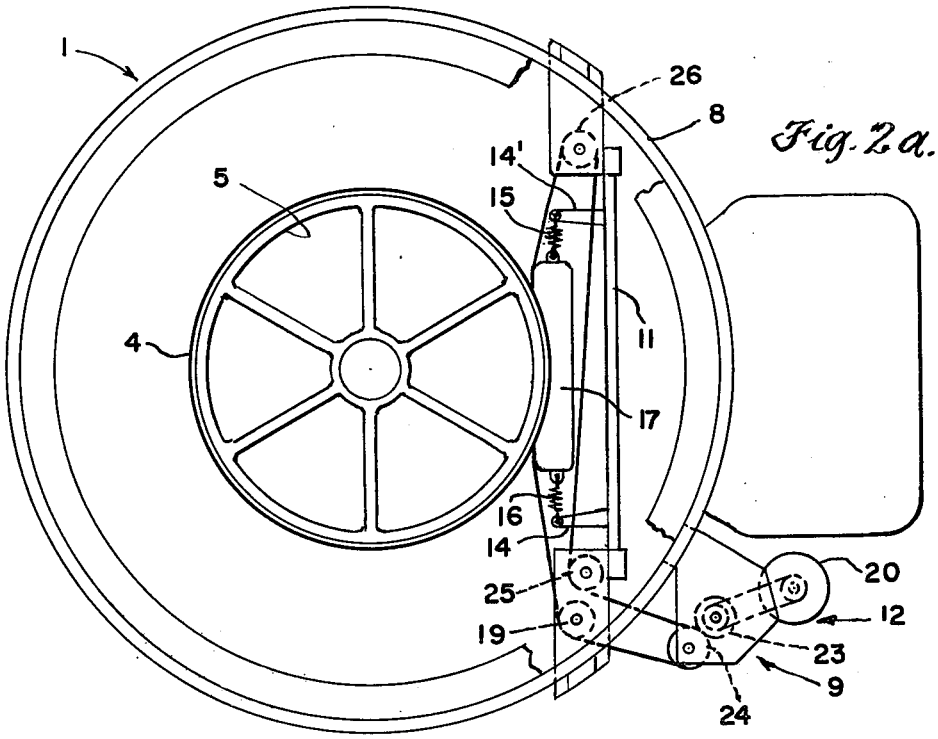
FIG. 2*a* is a similar plan view, illustrating a modification of the invention.

In this case, the winding device 12 works as a driving means to drive said emery and driving rollers 23, 24 are provided as illustrated in FIG. 2*a*. The emery, in the form of an endless belt, travels through driving rollers 23, 24, slip rollers 25, 26, emery supporting base 17, and slip roller 19, and naps the circular knitted fabric 4 while the emery is backed up by on the supporting base 17, the same as the form shown in FIG. 2 in which the emery is wound up in the form of a belt.

Figure 3:
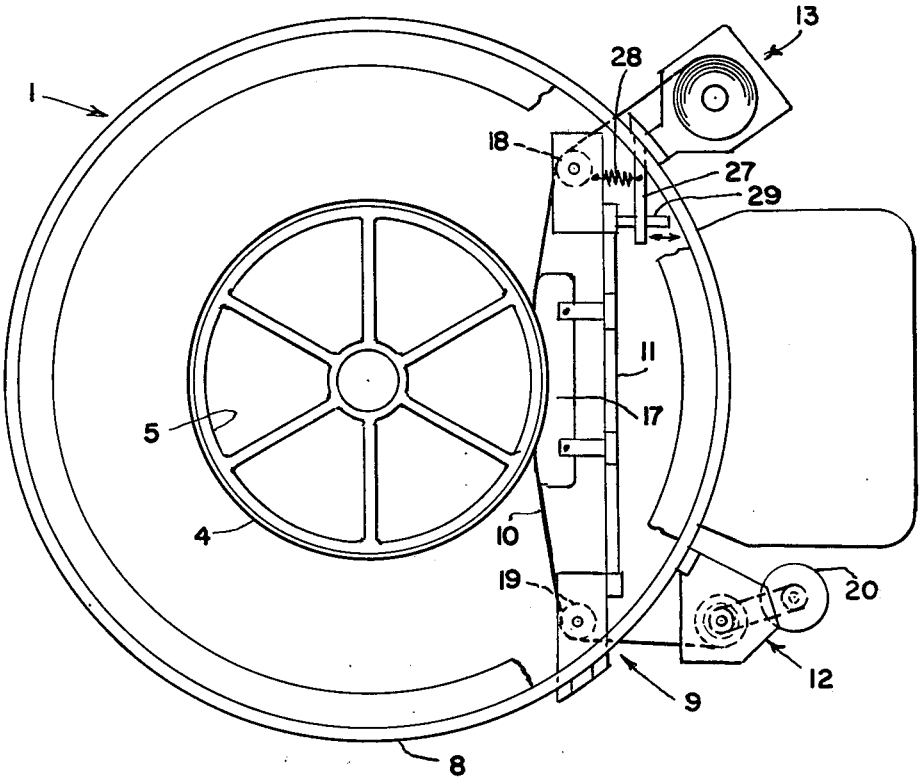
FIG. 3 is a similar plan view of another form of apparatus of the present invention.

FIG. 3 illustrates another embodiment of the present invention.

In FIG. 3, one end portion of the emery supporting frame 11, having a fixed support base 17, is connected to an arm 27 fixed on the frame of the knitting machine with a spring 28. Accordingly, the branch arm 29 of supporting frame 11 is slidable back and forth in the direction of the arrow. Accordingly, this end portion of support frame 11 is slidable in response to variations of the contact pressure between the emery and the circular knitted fabric.

The manner of securing the emery supply portion 13, slip roller 18, 19, emery winding portion 12, etc., on the circular knitted machine, is the same as in FIG. 2.

Also, the apparatus in FIG. 3 achieves the same effects as in FIG. 2.

Figure 4:
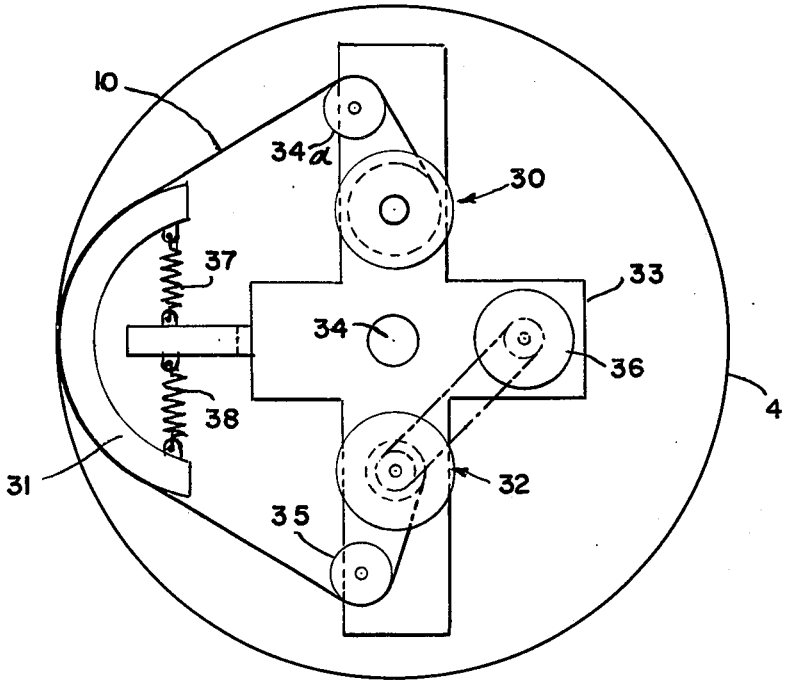
FIG. 4 is a similar plan view of still another embodiment in which a napping action is applied to the interior surface of a circular knitted fabric.

FIG. 4 is a plan view of an example in which napping action is applied to the interior surface of a circular knitted fabric by an apparatus according to the present invention.

In FIG. 4, supply portion 30, supporting base 31 and emery winding portion 32 are provided on a frame 33, and the frame 33 is fixed in the middle of the circular knitting machine by the main shaft 34.

Figure 5:
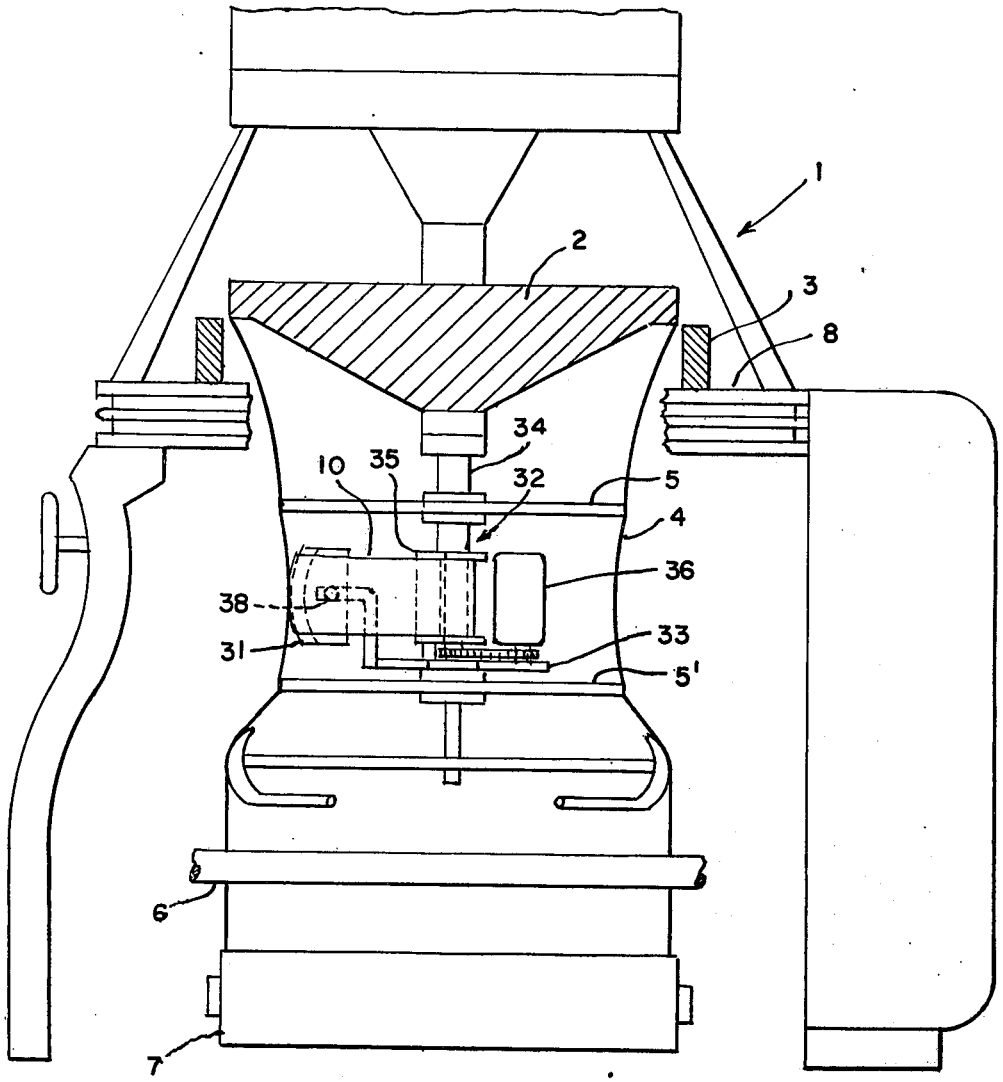
FIG. 5 is an elevational view of a circular knitting machine to which the apparatus shown in FIG. 4 is attached.

The frame is fixed to the knitting machine in a manner which is clear from the elevation view of FIG. 5.

In FIGS. 4 and 5, emery in the form of a belt 10 is taken from a supply portion 30 and wound up on a winding portion 32. It passes around a slip roller 34*a*, over a support base 31 and around a slip roller 35. The winding portion 32 is driven by the motor 36.

The effects of springs 37, 38 are the same as those of the previously mentioned case illustrated in FIGS. 2 and 3.

According to this invention, circular knitted fabric having uniform nap-length and nap-numbers may be produced in a single step. This is, at least in part, because an emery surface having proper roughness may be selected in accordance with the desired degree of napping, and the circular knitted fabric may be napped under conditions of uniform contact pressure by use of the apparatus of the present invention.

Moreover, it is not necessary to use any shearing process--namely, a process for shearing the knit fabric to make a napped fabric having uniform nap-length. Accordingly, it is possible to produce a napped circular knitted fabric at low cost by use of the present invention.

Figure 6:
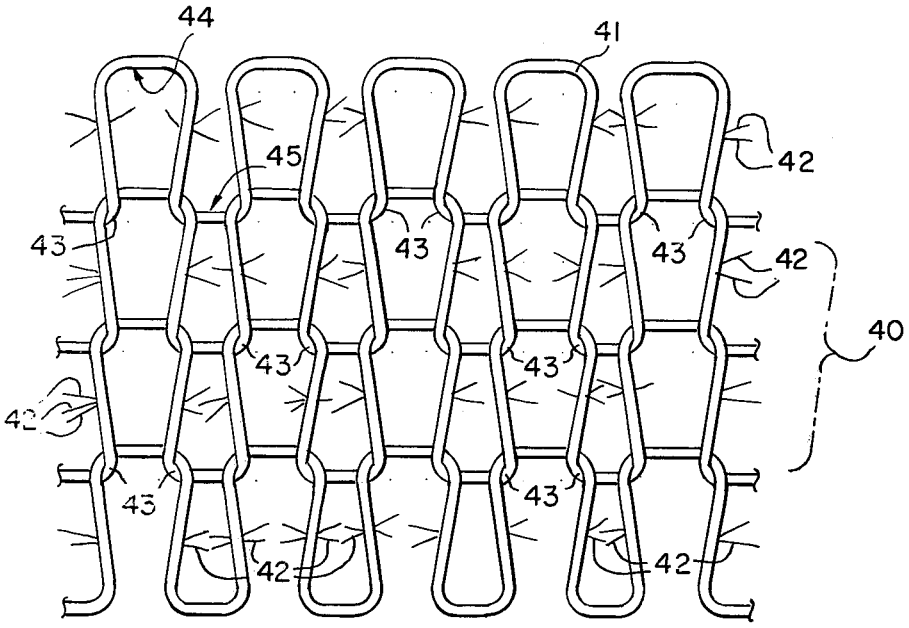
FIG. 6 is a face view of a typical knitted fabric showing naps formed in accordance with this invention.

Referring to FIG. 6 of the drawings, the circular knitted fabric 40 produced by the apparatus of the present invention possesses unique and excellent characteristics, which have not been achieved heretofore.

Because the apparatus of the present invention uses emery in the form of a belt, and because the emery supporting base is yieldable by use of springs or the like, the emery touches uniformly upon the overall surfaces of the loops in the circular knitted fabric, and the loops 41 in the circular knitted fabric are napped as indicated at 42 while they are being stretched in the coursewise direction as indicated by the arrow (c) in FIG. 6. This is important.

Accordingly, because the middle portion of each loop between the upper and lower loop intersecting points 43 of the knitted fabric is stretched in the coursewise direction, and the filaments are cut at points 42 while they are stretched to the limit, several filaments of the yarn naturally are cut at points 42 between the intersecting points 43 of the loops, namely between the needle loop 44 and the sinker loop 45.

For the above reason, in a circular knitted fabric 40 obtained by the present invention, filaments of the yarn are cut at several locations 42 between the needle loop 44 and the sinker loop 45; however, the points of intersection 43 of the loops are hardly cut at all.

Figure 7:
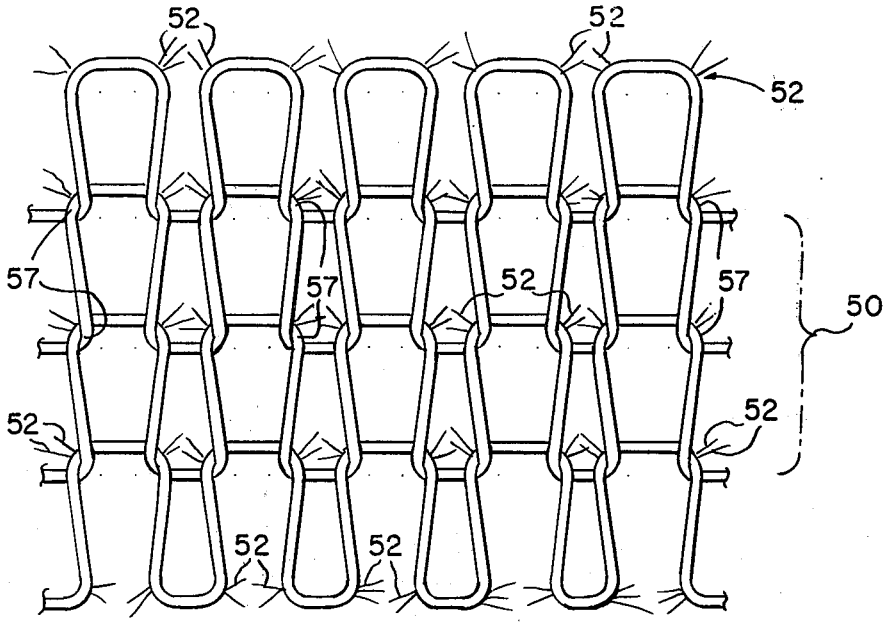
FIG. 7. (PRIOR ART)
FIG. 7 is a face view similar to FIG. 6, but showing naps produced according to prior art.

On the other hand, referring to FIG. 7 wherein the fabric 50 is not stretched in the coursewise direction, the usual napping apparatus uses a card cloth as the napping means, and the napping means does not have the ability to yield. The filaments tend to be cut at the contact points 51 of the knitted fabric and the napping means.

Because in such usual napping apparatus the points of intersection of the loops of the knitted fabric protrude more than the locations situated between the needle loop and the sinker loop, the points located between the intersections 51 of the loops hardly touch the napping means. Therefore, several filaments of the yarn located at the points of intersection of the loops of the knitted fabric are cut as indicated at 52.

When several filaments located at the points of intersection of the loops are cut in a circular knitted fabric, as in FIG. 7, the tenacity of the yarn at the intersecting points naturally weakens. Necessarily, the tenacity of the circular knitted fabric 50 itself is accordingly decreased.

When several filaments are cut at points 42 between the needle loop and the sinker loop, as in the present invention, reduction of tenacity at the points of intersection of the loops is rare. Therefore, by the use of this invention it is possible to prevent tenacity decrease of the resulting circular knitted fabric.

In the present invention, the desired degree of napping may be selected and obtained easily by replacing the emery with one having a different degree of roughness.

Although the degree of napping may be changed freely in a circular knitted fabric consisting of synthetic fiber continuous filaments, it is necessary that the number of filaments cut be less than two thirds of all filaments, to prevent reduction of tenacity of the knitted fabric.

When the number of filaments cut is above two thirds of all filaments, even the circular knitted fabric of the present invention can cause tenacity reduction.

However, with reference to the napped knitted fabric, it is necessary that the number of filaments must be at least one.

Whenever a single filament is cut, two naps, namely both ends of the cut filament, necessarily occur.

Accordingly, a circular knitted fabric consisting of synthetic fiber continuous filaments, produced by the apparatus of the present invention, has a number of naps within the following range.

$$2 \leqq Y \leqq (4/3)X$$

wherein $X$ is the number of filaments of the continuous filaments $Y$ is the number of naps on one side of a loop.

$(4/3)\ X$ is, of course, equal to $2 \times \frac{2}{3}\ X$.

The circular knitted fabric of this invention has almost no reduction of tenacity, comparing the napped circular knitted fabric with the knitted fabric before napping, and the degree of napping is excellent.

By selecting the material used in the present invention as follows, novel excellent napped circular knitted fabrics are obtained.

1. In order to create a wooly effect, it is preferred to use a bulky processed yarn of continuous filament synthetic yarns.
2. By using a mixed yarn of synthetic continuous filaments which differ in denier, a product having a different nap lengths and different deniers is mixed. Therefore, the resulting napped circular knitted fabric is excellent in surface effect, having a wooly feel.
3. By using a mixed yarn of synthetic continuous filament yarns which are different in color, the resulting napped circular knitted fabric has an excellent pepper-and-salt effect.
4. By uniting, twisting together or alternately knitting yarns which are different in tenacity, it is possible to make different nap-lengths exist in the resulting napped circular knitted fabric.

5. By using synthetic continuous filament yarns that are super-multifilament, the monofilament denier of which is below 2 denier, the resulting napped circular knitted fabric has a great nap effect, namely, many naps and long naps are obtained.
6. By using spun yarn, a flannel-like napped circular knitted fabric, having long naps, is obtained.

What is claimed is:

1. In an apparatus for napping a circular knitted fabric between the knitting portion and winding portion of a circular knitting machine, the combination which comprises means for stretching said fabric coursewise at a predetermined location, filament severing means positioned at said location and having emery in a beltlike form for severing filaments of said circular knitted fabric, said severing means including a supporting base for causing said emery to contact said circular knitted fabric, a supporting frame provided with yieldable means for yieldably supporting said supporting base, and driving means arranged to move said emery in a coursewise direction relative to said circular knitted fabric.

2. An apparatus according to claim 1, wherein means are provided for supplying the emery in a beltlike form and wherein a winding portion is provided for winding said emery, wherein said emery is wound up by said winding portion from said supplying portion via said emery supporting base.

3. An apparatus according to claim 1, wherein means are provided for moving said emery in beltlike form around the emery supporting frame as an endless belt.

4. An apparatus according to claim 1, wherein the emery is emery paper.

5. An apparatus according to claim 1, wherein the emery is emery cloth.

6. An apparatus according to claim 1, wherein the emery supporting base is spring-connected to the emery supporting frame.

7. An apparatus according to claim 1, wherein one end of the emery support frame is fixed to the frame of the circular knitting machine, and the other end is yieldably spring-connected to the frame of the circular knitting machine.

8. An apparatus according to claim 1, wherein said yieldable means includes spring means.

* * * * *